US008706440B2

(12) United States Patent
McNelis et al.

(10) Patent No.: US 8,706,440 B2
(45) Date of Patent: Apr. 22, 2014

(54) APPARATUS, SYSTEM, METHOD, AND COMPUTER PROGRAM PRODUCT FOR REGISTERING THE TIME AND LOCATION OF WEAPON FIRINGS

(75) Inventors: Niall B. McNelis, Sparks Glencoe, MD (US); Chris Bevard, Cockeysville, MD (US); Ryan Cardone, Reisterstown, MD (US)

(73) Assignee: AAI Corporation, Hunt Valley, MD (US)

( * ) Notice: Subject to any disclaimer, the term of this patent is extended or adjusted under 35 U.S.C. 154(b) by 490 days.

(21) Appl. No.: 12/487,539

(22) Filed: Jun. 18, 2009

(65) Prior Publication Data

US 2010/0324859 A1 Dec. 23, 2010

(51) Int. Cl.

| | |
|---|---|
| ***G06F 17/40*** | (2006.01) |
| ***G01D 21/00*** | (2006.01) |
| ***F41G 3/26*** | (2006.01) |
| ***F41G 3/00*** | (2006.01) |

(52) U.S. Cl.

USPC ..... 702/150; 702/86; 434/19; 434/21

(58) Field of Classification Search

USPC ..... 356/5.05, 141.1; 463/5; 273/371, 372, 273/348, 392, 406; 702/107, 86, 150, 151, 702/152, 153, 155–158; 434/21, 22, 11, 16, 434/19, 14

See application file for complete search history.

(56) References Cited

U.S. PATENT DOCUMENTS

| | | | | |
|---|---|---|---|---|
| 5,988,645 | A | 11/1999 | Downing | |
| 6,109,614 | A | 8/2000 | Ciarcia | |
| 6,415,211 | B1 | 7/2002 | Kotlow | |
| 6,484,115 | B1 * | 11/2002 | Freymond et al. | 702/104 |
| 6,549,872 | B2 | 4/2003 | Bollweg et al. | |
| 6,669,477 | B2 | 12/2003 | Hulet | |
| 7,329,127 | B2 * | 2/2008 | Kendir et al. | 434/21 |
| 2003/0082502 | A1 | 5/2003 | Stender et al. | |
| 2003/0136900 | A1 | 7/2003 | Shechter et al. | |
| 2004/0200109 | A1 | 10/2004 | Vasquez | |
| 2005/0116421 | A1 | 6/2005 | Kuosa | |
| 2006/0050610 | A1 | 3/2006 | Harvey et al. | |
| 2007/0035528 | A1 | 2/2007 | Hodge | |
| 2007/0067138 | A1 | 3/2007 | Rabin et al. | |

(Continued)

OTHER PUBLICATIONS

International Search Report and Written Opinion issue in PCT/US2010/39044, dated Mar. 11, 2011.

(Continued)

*Primary Examiner* — Marc Armand
*Assistant Examiner* — Ricky Ngon
(74) *Attorney, Agent, or Firm* — Venable LLP; Jeffri A. Kaminski

(57) ABSTRACT

An apparatus for registering time and location of a weapon firing of a weapon. The apparatus includes a microcontroller, a pressure sensor located in proximately is provided to the weapon and adapted to determine pressure data based on air pressure in proximity to the weapon and provide the pressure data to a microcontroller, an accelerometer located in proximity to the weapon and adapted to determine acceleration data based on movement of the weapon and provide the acceleration data to the microcontroller; a time device adapted to keep time and provide the time to the microcontroller; a location sensor located in proximity to the weapon and adapted to determine a location of the weapon and provide the location of the weapon to the microcontroller; and a memory coupled to the microcontroller.

18 Claims, 10 Drawing Sheets

(56) References Cited

U.S. PATENT DOCUMENTS

| | | | | |
|---|---|---|---|---|
| 2008/0020354 | A1 | 1/2008 | Goree et al. | |
| 2008/0167835 | A1 | 7/2008 | Zank et al. | |
| 2008/0289485 | A1 | 11/2008 | Quinn et al. | |
| 2009/0123894 | A1* | 5/2009 | Svane et al. | 434/20 |
| 2011/0252683 | A1* | 10/2011 | Chedid et al. | 42/1.03 |

OTHER PUBLICATIONS

International Search Report and Written Opinion issued in PCT/US10/39052, dated Mar. 11, 2011.

International Search Report and Written Opinion Issued in PCT/US2010/39049, dated Mar. 4, 2011.

International Preliminary Report on Patentability and Written Opinion of the International Search Authority, International Application No. PCT/US10/39049; issued Jan. 5, 2012.

International Preliminary Report on Patentability and Written Opinion of the International Search Authority, International Application No. PCT/US10/39052; dated Jan. 5, 2012.

International Preliminary Report on Patentability and Written Opinion of the International Search Authority, International Application No. PCT/US10/39044; issued Jan. 5, 2012.

* cited by examiner

APPARATUS, SYSTEM, METHOD, AND COMPUTER PROGRAM PRODUCT FOR REGISTERING THE TIME AND LOCATION OF WEAPON FIRINGS

CROSS-REFERENCE TO RELATED APPLICATIONS

The present application is related to co-pending U.S. patent application Ser. No. 12/487,545 entitled "Method and System For Correlating Weapon Firing Events With Scoring Events," and co-pending U.S. patent application Ser. No. 12/487,542 entitled "Apparatus, System, Method, and Computer Program Product for Detecting Projectiles," the contents of which are incorporated herein by reference in their entirety.

BACKGROUND

When new military weapons are evaluated, it may be advantageous to evaluate the weapons under actual combat conditions. Thus soldiers and marines may be run through actual platoon attack scenarios with live fire. However, to determine the effectiveness of the weapon, or the skill of the user of the weapon, each bullet fired must be correlated with the impact point of that bullet. This requires that each bullet fired be linked to the weapon that fired it, and that the time and location of the firing be known. Marking bullets, for example, through coloration, may allow bullets to be linked back to the respective weapons of the bullets, but provides no information as to where and when the bullet was fired. Bullets may also be lost, especially if the bullets miss the bullets' target, or if the bullets are destroyed, if the bullets hit a target.

SUMMARY

An exemplary embodiment of the present invention sets forth an apparatus for registering time and location of a weapon firing of a weapon. The apparatus includes a microcontroller, a pressure sensor located in proximately to the weapon and adapted to determine pressure data based on air pressure in proximity to the weapon and provide the pressure data to a microcontroller, an accelerometer located in proximity to the weapon and adapted to determine acceleration data based on movement of the weapon and provide the acceleration data to the microcontroller; a time device adapted to keep time and provide the time to the microcontroller; a location sensor located in proximity to the weapon and adapted to determine a location of the weapon and provide the location of the weapon to the microcontroller; and a memory coupled to the microcontroller. The microcontroller is adapted to determine if a weapon firing has occurred based on the acceleration data and the pressure data. The microcontroller is adapted to retrieve and then transmit the acceleration data, the pressure data, the time, and the location of the weapon when the weapon firing occurred for storage in the memory.

According to one exemplary embodiment, the time device and the location device are combined into a combined device.

According to one exemplary embodiment, the apparatus may further include a momentary switch coupled to the microcontroller and adapted allow a user to communicate at least one of the pressure sensor, the accelerometer, the time device, the location device, and the microcontroller.

According to one exemplary embodiment, the apparatus may further include a momentary switch coupled to at least one of the pressure sensor, the accelerometer, the time device, and the location device and adapted to turn at least one of the pressure sensor, the accelerometer, the time device, the location device, and the microcontroller on and off.

According to one exemplary embodiment, the apparatus may further include an input/output (I/O) data port. The data port is coupled to the microcontroller.

According to one exemplary embodiment, the I/O data port comprises at least one of a wireless interface or a wired interface.

According to one exemplary embodiment, the microcontroller comprises digital signal processing (DSP) capabilities.

According to one exemplary embodiment, the apparatus may further include a power supply disposed within the housing.

According to one exemplary embodiment, the power supply comprises at least of a battery; a rechargeable battery; a non-rechargeable battery; a fuel cell; or a hydrogen fuel cell.

According to one exemplary embodiment, the apparatus may further include a signal conditioning unit coupled to at least one of the pressure sensor or the accelerometer and adapted to condition the pressure data and the acceleration data before the pressure data and the acceleration data is provided to the microcontroller.

According to one exemplary embodiment, the apparatus the memory stores a weapon firing signature. The microcontroller determines if a weapon firing has occurred by comparing the acceleration data and the pressure data to the weapon firing signature.

According to one exemplary embodiment, the apparatus may further include a transceiver for transmitting the acceleration data, the pressure data, the time, and the location of the weapon when the weapon firing occurred for storage in the memory.

According to one exemplary embodiment, the transceiver comprises at least one of a wired interface, a wireless interface, RS-232 interface, a wired USB port, a firewire port, an eSATA port, and/or a proprietary port, or a wireless USB device, Bluetooth device, or IEEE 802.11x standard wi-fi connection, and IEEE 802.16x wimax connection.

According to an exemplary embodiment, the present invention sets forth a method for registering time and location of weapon firings of a weapon. The method includes determining pressure data based on air pressure in proximity to the weapon; determining acceleration data based on movement of the weapon; analyzing the pressure data and the acceleration data to determine if a weapon firing has occurred; and if the weapon firing has occurred: determining a time of the weapon firing; determining a location of the weapon firing; and storing the pressure data, the acceleration data, the time, and the location in a memory.

According to one exemplary embodiment, the method may further include transmitting the pressure data, the acceleration data, the time, and the location to a device for storage.

According to one exemplary embodiment, the analyzing step further comprises comparing the acceleration data and the pressure data to a weapon firing signature to determine if a weapon firing has occurred.

According to an exemplary embodiment, the present invention sets forth a method for registering time and location of weapon firings of a weapon. The method includes receiving pressure data based on air pressure in proximity to the weapon; receiving acceleration data based on movement of the weapon; receiving a current time; receiving a current location of the weapon; analyzing the pressure data and the acceleration data to determine if a weapon firing has occurred; and if the weapon firing has occurred, storing the pressure data, the acceleration data, the time, and the location in a memory.

According to an exemplary embodiment, the method may further include transmitting the pressure data, the acceleration data, the time, and the location to a device for storage.

According to an exemplary embodiment, the analyzing step further comprises comparing the acceleration data and the pressure data to a weapon firing signature to determine if a weapon firing has occurred.

Further features of the embodiments, as well as the structure and operation of various embodiments, are described in detail below with reference to the accompanying drawings.

BRIEF DESCRIPTION OF THE DRAWINGS

The foregoing and other features and advantages of the invention will be apparent from the following, more particular description of various exemplary embodiments, as illustrated in the accompanying drawings wherein like reference numbers generally indicate identical, functionally similar, and/or structurally similar elements. The left most digits in the corresponding reference number indicate the drawing in which an element first appears.

DETAILED DESCRIPTION OF THE EMBODIMENTS

Exemplary embodiments are discussed in detail below. While specific exemplary embodiments are discussed, it should be understood that this is done for illustration purposes only. In describing and illustrating the exemplary embodiments, specific terminology is employed for the sake of clarity. However, the embodiments are not intended to be limited to the specific terminology so selected. A person skilled in the relevant art will recognize that other components and configurations may be used without parting from the spirit and scope of the embodiments. It is to be understood that each specific element includes all technical equivalents that operate in a similar manner to accomplish a similar purpose. The examples and embodiments described herein are non-limiting examples.

Figure 1:
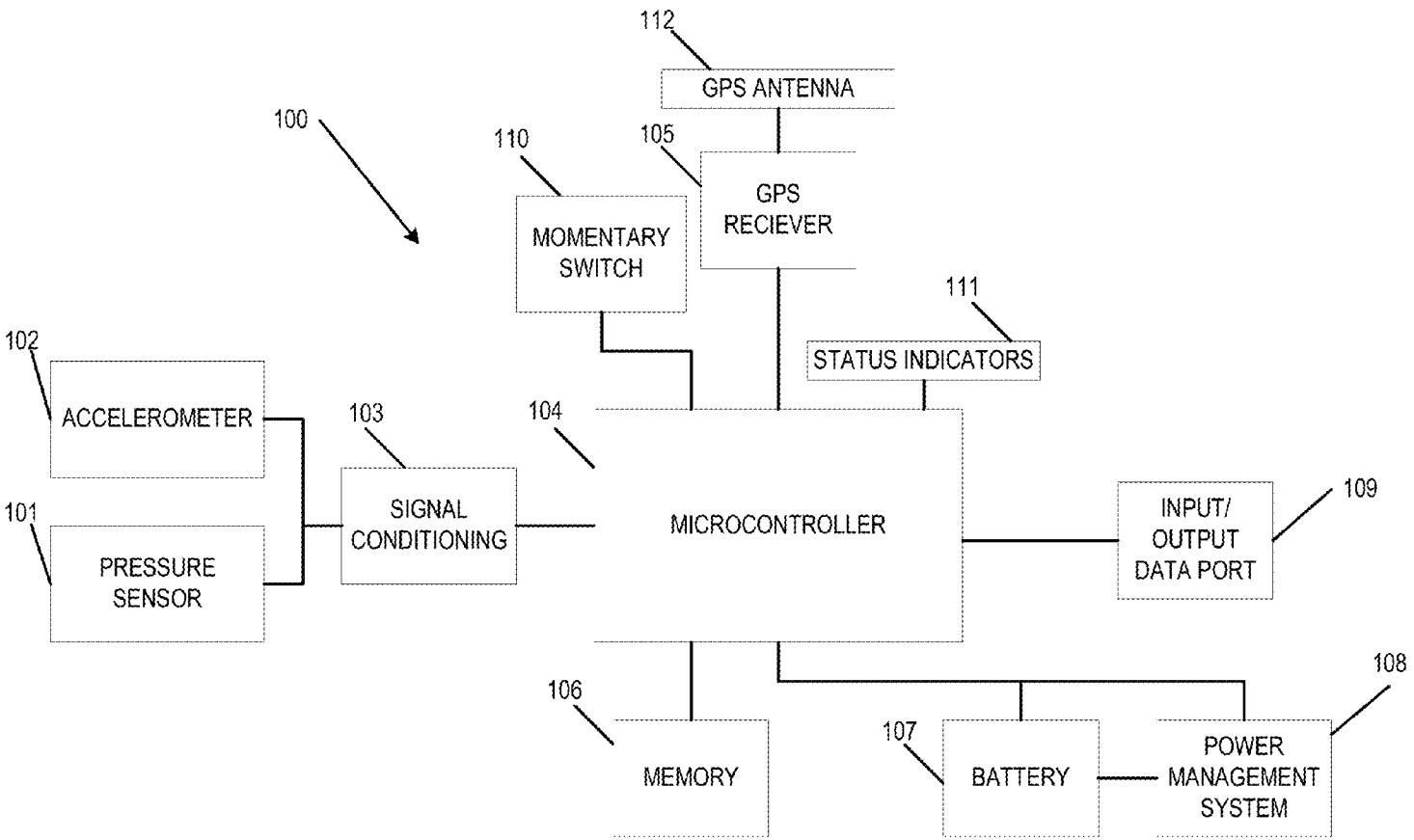
FIG. 1 depicts an exemplary block diagram for an apparatus for registering the time and location of weapon firings.

FIG. 1 depicts an exemplary block diagram for an exemplary embodiment of an apparatus 100 for registering the time and location of a weapon's firings. The exemplary apparatus may include, e.g., but is not necessarily limited to, a pressure sensor 101, an accelerometer 102, a signal conditioning unit 103, a global positioning system (GPS) a receiver 105, a GPS antenna 112, a momentary switch 110, status indicators 111, an input/output data port 109, a memory 106, a battery 107, a power management system 108, and a microcontroller 104.

In an exemplary embodiment of the apparatus 100 for registering the time and location of weapon's firings, the pressure sensor 101 and the accelerometer 102 may each transmit signals to the signal conditioning unit 103. The signal conditioning unit 103 may process the signals and transmit the signals to the microcontroller 104. Signals received by the microcontroller 104 from the pressure sensor 101 and the accelerometer 102 may be used to determine whether a weapon firing has occurred.

In an exemplary embodiment of the apparatus 100 for registering the time and location of weapon's firings, the GPS antenna 112 may be coupled/connected to the GPS receiver 105. The GPS receiver 105 may transmit data to the microcontroller 104. In an exemplary embodiment, once the microcontroller 104 determines a weapon firing has occurred, data pertaining to the weapon firing from the GPS receiver 105 may be stored in the memory 106. In an exemplary embodiment, the GPS receiver 105 and the GPS antenna 112 may be replaced by any other device capable of determining the weapon's location.

In an exemplary embodiment of the apparatus 100 for registering the time and location of weapon's firings, the power management system 108 may be coupled/connected to, e.g., but not limited to, the battery 107, and may control the distribution of power to each component of the apparatus 100 and/or the recharging of the battery 107.

In an exemplary embodiment, once a weapon firing event is determined to have occurred, the microcontroller 104 may store data relating to the weapon firing in memory 106 and/or may transmit data relating to the weapon firing via the input/output data port 109. In an exemplary embodiment, the data may comprise, e.g., but not limited to, the time of each weapon firing event, the location of each weapon firing event (as determined by the GPS receiver 105), the waveforms from the pressure sensor 101, and/or the waveforms from the accelerometer 102.

In an exemplary embodiment, in addition to storing data relating to a weapon firing, the microcontroller 104 may continuously, or at set intervals, store data relating to the location of the weapon (as determined by the GPS receiver 105) and/or transmit data relating to the location of the weapon firing via input/output data port 109.

In an exemplary embodiment, the input/output data port 109 may be used to input data to and/or retrieve data from the apparatus 100 for registering the time and location of weapon's firings 100. The input/output data port 109 may be used to send information relating to the weapon firing from the pressure sensor 101 and/or the accelerometer 102 to an external interface. In an exemplary embodiment, the input/output data port 109 may also be used to calibrate, program, repair, and/or communicate with the pressure sensor 101, the accelerometer 102, the signal conditioning unit 103, the GPS receiver 105, the GPS antenna 112, the momentary switch 110, the status indicators 111, the memory 106, the battery 107, the power management system 108, and/or the microcontroller 104. According to an exemplary embodiment, the microcontroller 104 may be a processor such as, but not limited to, a digital signal processor.

In an exemplary embodiment, the apparatus 100 for registering the time and location of weapon's firings may transmit information relating to the weapon firing in real-time, via the input/output data port 109, to an external device and/or may store information relating to the weapon firing in memory 106. Stored information relating to the weapon firing may in an exemplary embodiment be transmitted to an external device, via the input/output data port 109, at a later time.

An exemplary embodiment of an apparatus 100 for registering the time and location of weapon's firings may be used to, e.g., but not limited to, to register the time and location of a weapon's firing; to evaluate/monitor a weapon's performance in a real or simulated combat situation; to evaluate/monitor a soldier's actions in a real or simulated combat situation where the soldier's weapon contains an apparatus; and/or to program/fix other apparatuses for use on the same or similar weapon. In an exemplary embodiment, the soldier's actions may include, e.g., but are not limited to, weapon firings, battlefield movements, coordination with other soldiers, and weapon reloads.

Figure 2A:
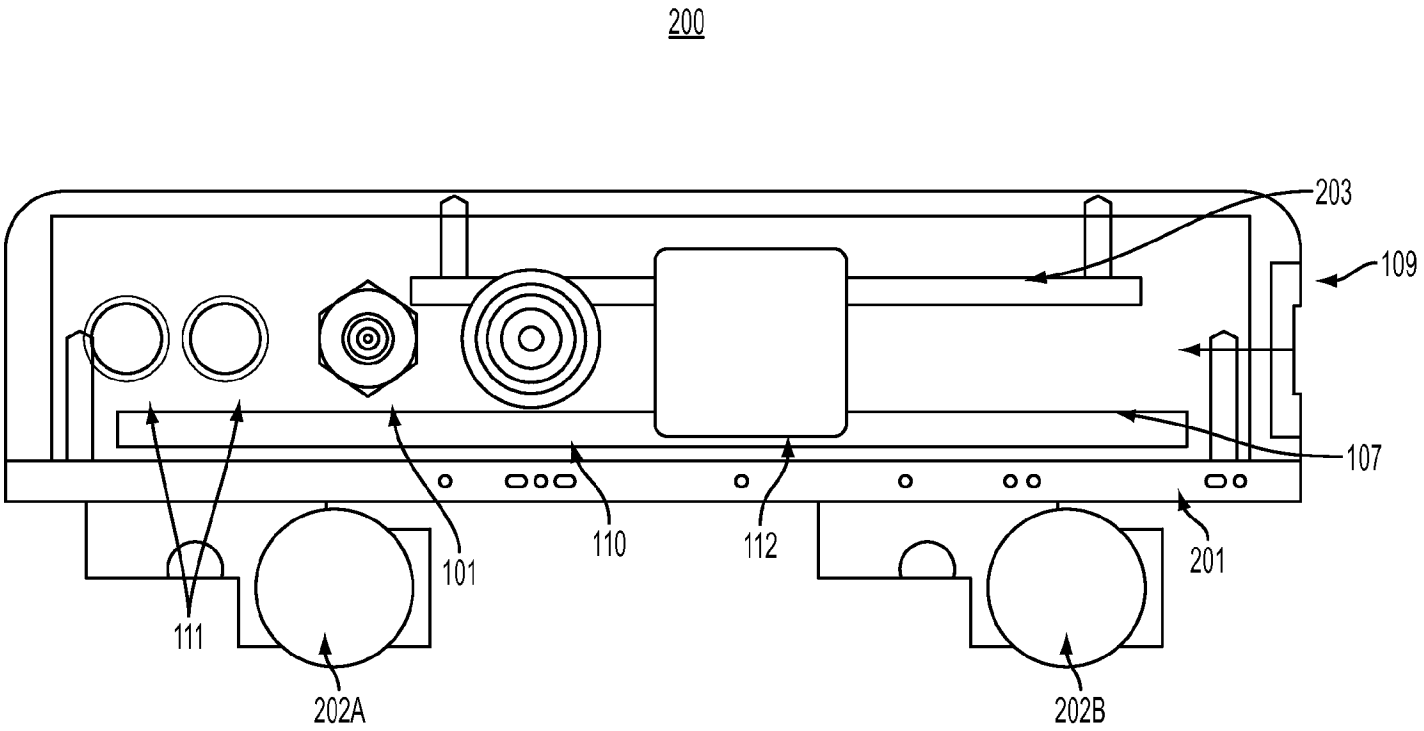
FIGS. 2A-B depict an exemplary apparatus for registering the time and location of weapon firings.
Figure 2B:
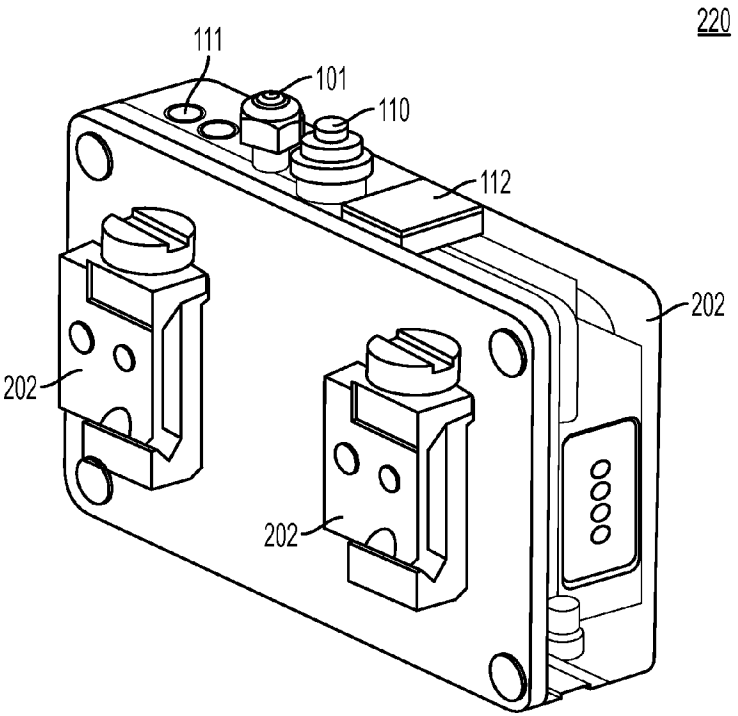

FIGS. 2A-B referred to as edgeview diagram 200, or orthogonal view diagram 220, respectively, depict an exemplary apparatus 100 for registering the time and location of weapon firings. Housing 201 may include, e.g., but is not limited to, the pressure sensor 101, the accelerometer 102 (not shown), the signal conditioning unit 103 (not shown), the GPS receiver 105 (not shown), the GPS antenna 112, the momentary switch 110, the status indicators 111, the input/output data port 109, the memory 106 (not shown), the battery 107, the power management system 108 (not shown), and the microcontroller 104 (not shown), each of which are depicted in FIG. 1. The housing 201 may be attached or coupled to a weapon via, e.g., but not limited to, rail mounts 202 *a, b* (collectively 202) on housing 201.

The housing 201 may be case made of any suitable materials, such as, for example, but not limited to, plastic, metal, rubber, and/or composites, in any suitable design. The other elements of the apparatus 100 may be disposed on or within the housing 201. The housing 201 may be designed of materials appropriate to withstand the stress (e.g., vibration, etc.) of being attached to a weapon that will be fired repeatedly.

The rail mount 202 may be disposed on the outside of the housing 201 as shown in orthogonal view diagram 220. The rail mount 202 may be made of any suitable material in any suitable design for allowing the secure attachment of the housing 201 to a weapon (not shown). More than one rail mount 202 may be disposed on the housing 201.

Figure 3B:
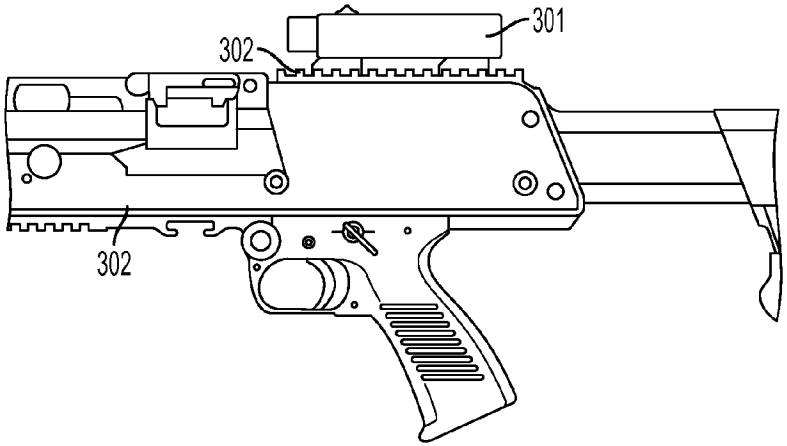
FIGS. 3A-C, depict an exemplary apparatus for registering the time and location of weapon firings mounted on an exemplary weapon.
Figure 3C:
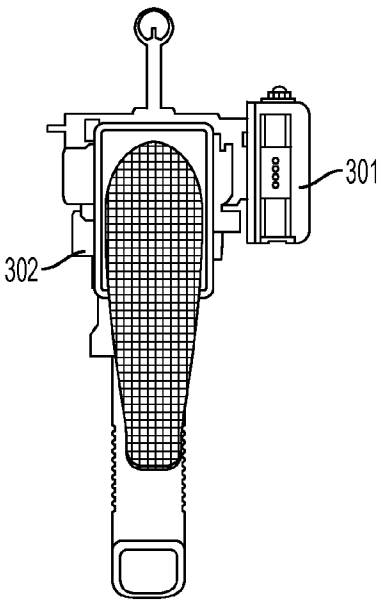
Figure 3A:
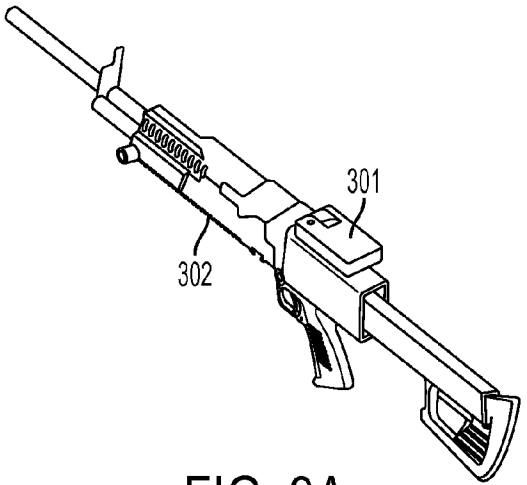

FIGS. 3A-C depict exemplary orthogonal view diagram 300, exemplary side view diagram 304, and exemplary rear-view diagram 305 of an exemplary apparatus 100 for registering the time and location of weapon firings mounted on an exemplary weapon. An apparatus 301 may be attached to an exemplary weapon 302 by attaching the rail mounts 202 of the apparatus to the exemplary weapon 302. The exemplary weapon 302 may be any firearm, such as, for example, but not limited to, the depicted M16, or any other projectile based weapon whose firing may be detected via an accelerometer 102 and/or a pressure sensor 101. The exemplary weapon 302 may include one or more mounting points 303, for example the top mounting point of FIGS. 3A and 3B depicted in side view 304 of FIG. 3B, to which the rail mounts 202 may be attached or coupled. The mounting point 303 may include, for example, a mounting rail, such as, but not limited to, a Picatinny rail, manufactured by and available from Picatinny Arsenal, of Picatinny Arsenal, N.J. USA.

Alternatively, the apparatus 301 may be side mounted as depicted by 305 of FIG. 3C.

In another alternative, the apparatus 301 may be located in proximity to the exemplary weapon 302 but not attached thereto.

Returning to FIG. 2A, in an exemplary embodiment, a control board 203 may be any suitable circuit board disposed within the housing 201. The components of the apparatus 100, 200, including, for example, the pressure sensor 101, the accelerometer 102, the signal conditioning unit 103, the microcontroller 104, the GPS receiver 105, the memory 106, the battery 107, the power management system 108, the input/output data port 109, the antenna 112, the momentary switch 110, the status indicators 111, and/or the GPS antenna 112 may be disposed on, or coupled/connected to, the control board 203. Elements not disposed directly on the control board 203 may be coupled/connected to other elements directly disposed on the control board 203.

Returning to FIG. 1, the pressure sensor 101 may be any sensor capable of detecting changes in pressure in the vicinity of the pressure sensor 101. For example, the pressure sensor 101 may be a TDCue Sensor manufactured by and available from the AAI Corporation of Cockeysville, Md. USA. The pressure sensor 101 may be disposed on the outside of housing 201, for example, as depicted in FIGS. 2A-B, as the pressure sensor 101 may require exposure to air outside of the housing 201 to function properly. In an exemplary embodiment, pressure data from the pressure sensor 101 may be constantly transmitted to the microcontroller 104 through signal conditioning unit 103. Alternatively, in another embodiment, the microcontroller 104 may poll the pressure sensor 101 at set intervals or event-based intervals. The pressure sensor 101 may be sensitive enough to detect changes in pressure, i.e., air pressure, to allow the microcontroller 104 to distinguish between non-weapon firing events of the exemplary weapon 302 to which the pressure sensor 101 may be attached and the weapon firing events of the exemplary weapon 302 to which the pressure sensor 101 may be attached.

The accelerometer 102 may be any sensor capable of detecting changes in the magnitude and/or direction of the acceleration of the accelerometer 102 itself. For example, the accelerometer 102 may be a piezoelectric sensor. As with the pressure sensor 101, acceleration data from the accelerometer 102 may be constantly transmitted to the microcontroller 104, or the microcontroller 104 may poll the accelerometer 102 according to exemplary embodiments. The accelerometer 102 may be disposed on or within the housing 201, and may be disposed on the control board 203 in an exemplary embodiment. The accelerometer 102 may be sensitive enough to detect changes in the magnitude and/or direction of the acceleration of the accelerometer 102 itself in order to distinguish between non-weapon firing events of the exemplary weapon 302 to which the accelerometer 102 may be attached and the weapon firing events of the exemplary weapon 302 to which the accelerometer 102 may be attached.

The signal conditioning unit 103 may be any suitable electronics for conditioning the signals containing the data from the pressure sensor 101 and the accelerometer 102 so that the signals may be processed by the microcontroller 104. For example, if the signals from the pressure sensor 101 are too weak for the microcontroller 104 to process correctly, the signal conditioning unit 103 may amplify the signals from the pressure sensor 101 to levels suitable for processing by the microcontroller 104. The signal conditioning unit 103 may convert or filter signals from the pressure sensor 101 and the accelerometer 102, for example, to change the signals into a format recognizable by the microcontroller 104, or, e.g., to remove noise from the signals. The signal conditioning unit 103 may be disposed within the housing 201, on the control board 203 in an exemplary embodiment.

The microcontroller 104 may be any suitable microprocessor capable of processing the data received from the pressure sensor 101, the accelerometer 102, and the GPS receiver 105. Data from the pressure sensor 101 and the accelerometer 102 may be sent to the microcontroller 104, which may use the data to determine whether the weapon has been fired. If the weapon has been fired, the microcontroller 104 may send the data from the pressure sensor 101, the accelerometer 102, and the GPS receiver 105 to the memory 106. The microcontroller 104 may also receive input from the momentary switch 110, control the status indicators 111, and, if necessary, facilitate the transfer of data from the memory 106 through the input/output data port 109. The microcontroller 104 may be disposed within the housing 201, on the control board 203 in an exemplary embodiment.

The GPS receiver 105 may be any suitable device for receiving and interpreting GPS signals to determine the location of the GPS receiver 105 at any particular time. The GPS receiver 105 may be disposed within the housing 201, on the control board 203 or otherwise coupled/connected thereto, or attached to the outside of the housing 201, according to exemplary embodiments. When the microcontroller 104 determines that the exemplary weapon 302 has been fired, the microcontroller 104 may request time and location data from the GPS receiver 105. The GPS receiver 105 may need to be sensitive enough to determine location precisely and accurately enough to allow for the positions of two GPS receivers 105 of one or more of the apparatus 100 attached to one or more weapons located in close proximity to be distinguishable. If the GPS receiver 105 loses the GPS signal, and is therefore unable to determine the location of the exemplary weapon 302 on the basis of the GPS signal, the GPS receiver 105 may be able to determine the location of the weapon through interpolation. The microcontroller 104 may assist the GPS receiver 105 with the calculation necessary to perform the interpolation, if necessary.

The memory 106 may be any computer readable medium suitable for usage inside the housing 201. For example, the memory 106 may be removable or non-removable memory, storage, etc., such as, but not limited to, flash memory, a magnetic drive, an optical drive capable of fitting within the housing 201, etc. The microcontroller 104 may read from and write to the memory 106. Program code used by the microcontroller 104, for example, program code for analyzing data from the pressure sensor 101 and the accelerometer 102, including data and/or parameters, such as, for example, but not limited to, a weapon firing signature, that the microcontroller 104 may use in determining if the weapon has been fired, may be pre-written to the memory 106. Data from the pressure sensor 101, the accelerometer 102, and the GPS receiver 105 may be written to the memory 106 by the microcontroller 104 on the occurrence of certain events, such as, for example, but not limited to, a firing of the weapon as determined by the microcontroller 104. The memory 106 may be directly accessible by any suitable device coupled/connected to the input/output data port 109, or the microcontroller 104 may be used as an intermediary by such a device. The memory 106 may be disposed within the housing 201, and may be directly disposed on the control board 203, or may be disposed elsewhere within the housing 201 and coupled/connected to the control board 203. The memory 106 may be fixed or removable. For example, if the memory 106 is a Secure Digital flash memory card, the memory 106 may be inserted into the housing 201 through a slot in the housing 201, and may be removable.

The battery 107 may be any suitable power source for providing power to the apparatus. For example, the battery 107 may be a rechargeable battery, such as, e.g., but not limited to, nickel cadmium, nickel metal hydride, zinc, or a lithium-ion battery, or a non-rechargeable battery such as, e.g., but not limited to, lead acid, and may removable from the housing 201, or non-removable. The battery 107 may be designed specifically for the apparatus, or may be a more common battery cell type such as, but not limited to, a hearing aid battery, a 9V, an AAA, or an AA battery. The housing 201 may be designed to accept multiple battery types. Power from the battery 107 may be used to run all of the electronic elements of the apparatus. Battery 107 may be replaced by another power device such as, e.g., but not limited to, a hydrogen fuel cell, or the like.

The power management system 108 may be any suitable electronic circuit for managing the apparatus's use of power from the battery 107 and/or the recharging of the battery 107. For example, the power management system 108 may control the distribution of power to the microcontroller 104 to ensure that the microcontroller 104 doesn't unnecessarily drain the battery 107. The power management system 108 may be disposed within the housing 201, on or coupled/connected to the control board 203, and connected/coupled to the battery 107.

The input/output data port 109 may be any suitable port or combination of ports for connecting the apparatus to another device, such as, for example, but not limited to, a computing device, to allow the other device to access the elements of the apparatus. The input/output data port 109 may be a wired port requiring a physical connection via a cable, or may include a wireless port implemented as e.g., a wireless transceiver device. For example, the input/output data port 109 may be a RS-232 interface, a wired USB port, a firewire port, an eSATA port, and/or a proprietary port, or a wireless USB device, Bluetooth device, or IEEE 802.11x standard wi-fi, IEEE 802.16x wimax, or other wireless device. The input/output data port 109 may allow a coupled/connected device access to the pressure sensor 101, the accelerometer 102, the microcontroller 104, the GPS receiver 105, the memory 106, and the battery 107, for example, to allow for, e.g., the testing and calibration of the components of the apparatus. A coupled/connected device may use the input/output data port 109 to read stored data from the memory 106, and to write program code for use by the microcontroller 104 to the memory 106. The input/output data port 109 may also be used, e.g., to draw power to recharge the battery 107. If the input/output data port 109 is a wired port, the input/output data port 109 may be disposed on the outside of the housing 201, as illustrated in diagram 200 in FIG. 2A. If the input/output data port 109 is a wireless port, the wireless device used to implement the input/output data port 109 may be disposed within or outside the housing, on or coupled/connected to the control board 203.

The momentary switch 110 may include one or more suitable switch(es), button(s), or other input device(s) disposed on the outside of the housing 201. The momentary switch 110 may be positioned on the housing 201 such that the user of the apparatus may be able to access the momentary switch 201 when the apparatus is attached to a weapon. The momentary switch 110 may be used, e.g., but not limited to, to input data to the microcontroller 104, to allow a user to control the operation of the apparatus, to allow a user to turn the apparatus on/off, and indicate various conditions to the microcontroller 104. For example, the user may press the momentary switch 110 while the apparatus is attached to a weapon to signal that the weapon has jammed. The user may press the momentary switch when the jam is cleared. The microcontroller 104 may write the occurrence of the weapon jam and the time the jam occurred, along with the time the jam was cleared, to the memory 106. As another example, holding the momentary switch 110 down for a specified period of time may signal the apparatus to enter a low-power consumption mode, or to shut down.

The status indicators 111 may be one or more lights or light emitting diode (LED) indicators of varying colors, a LED screen, a liquid crystal display (LCD) device or any other suitable visual display device. For example, as depicted in FIGS. 2A-B, the status indicators 111 may be a pair of LED indicators disposed on the outside of the housing 201, next to the momentary switch 110. The status indicators 111 may be used to convey information about the status of the apparatus, and the various elements thereof, to a user of the apparatus. For example, the status indicators 111 may indicate the condition of the battery 107 such as, e.g., but not limited to, low battery, battery charging, and/or battery charged, attainment or loss of the GPS signal by the GPS receiver 105, data transfer activity through the input/output data port 109, whether the device is on or off, etc.

The GPS antenna 112 may be any antenna suitable for use with the GPS receiver 105. The GPS antenna 112 may be disposed on the outside or the inside of the housing 201. The GPS antenna 112 may pick up GPS signals and relay the GPS signals to the GPS receiver 105.

Figure 4A:
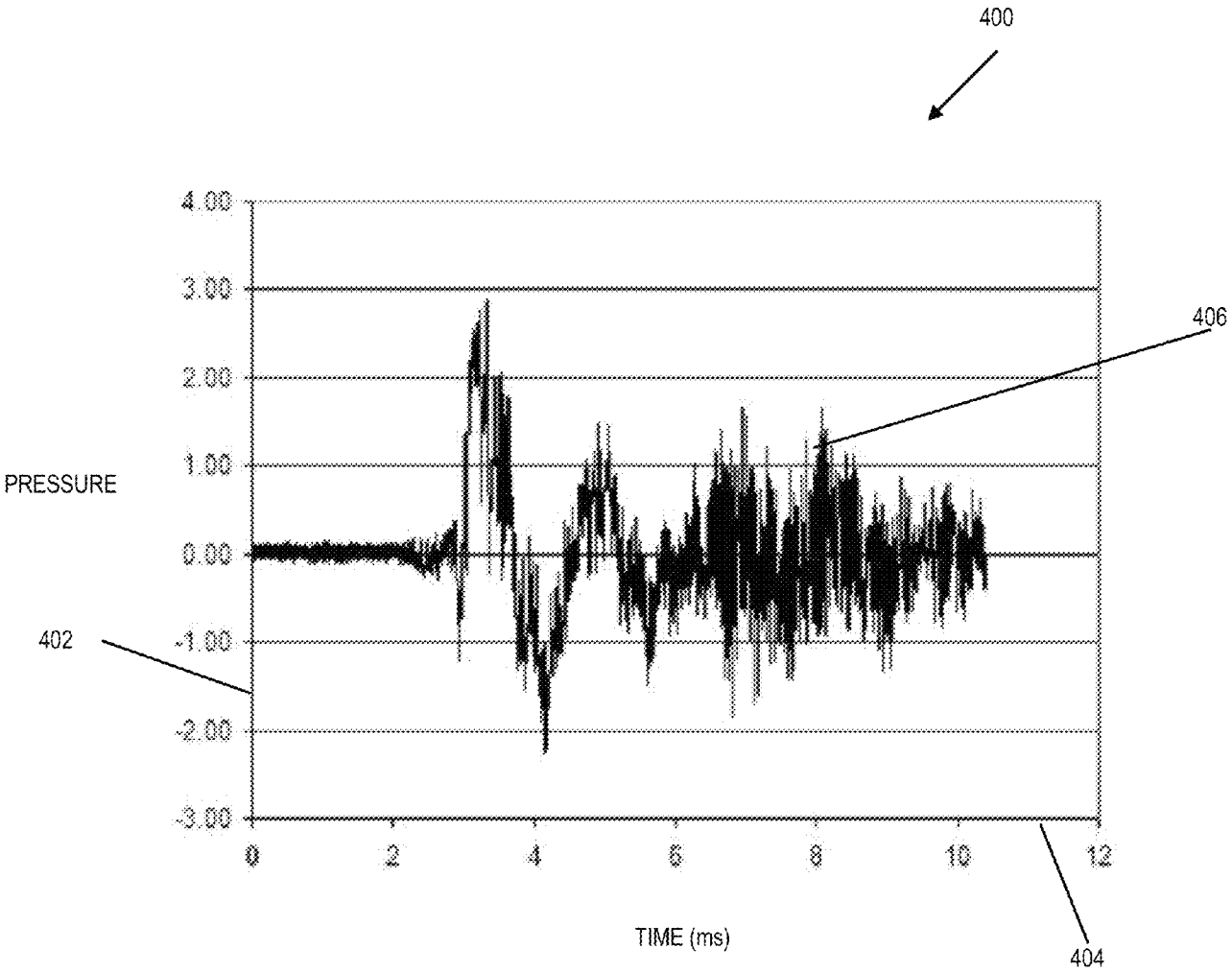
FIGS. 4A and 4B depict exemplary graphs for sensor output during a single exemplary weapon firing of an exemplary weapon.
Figure 4B:
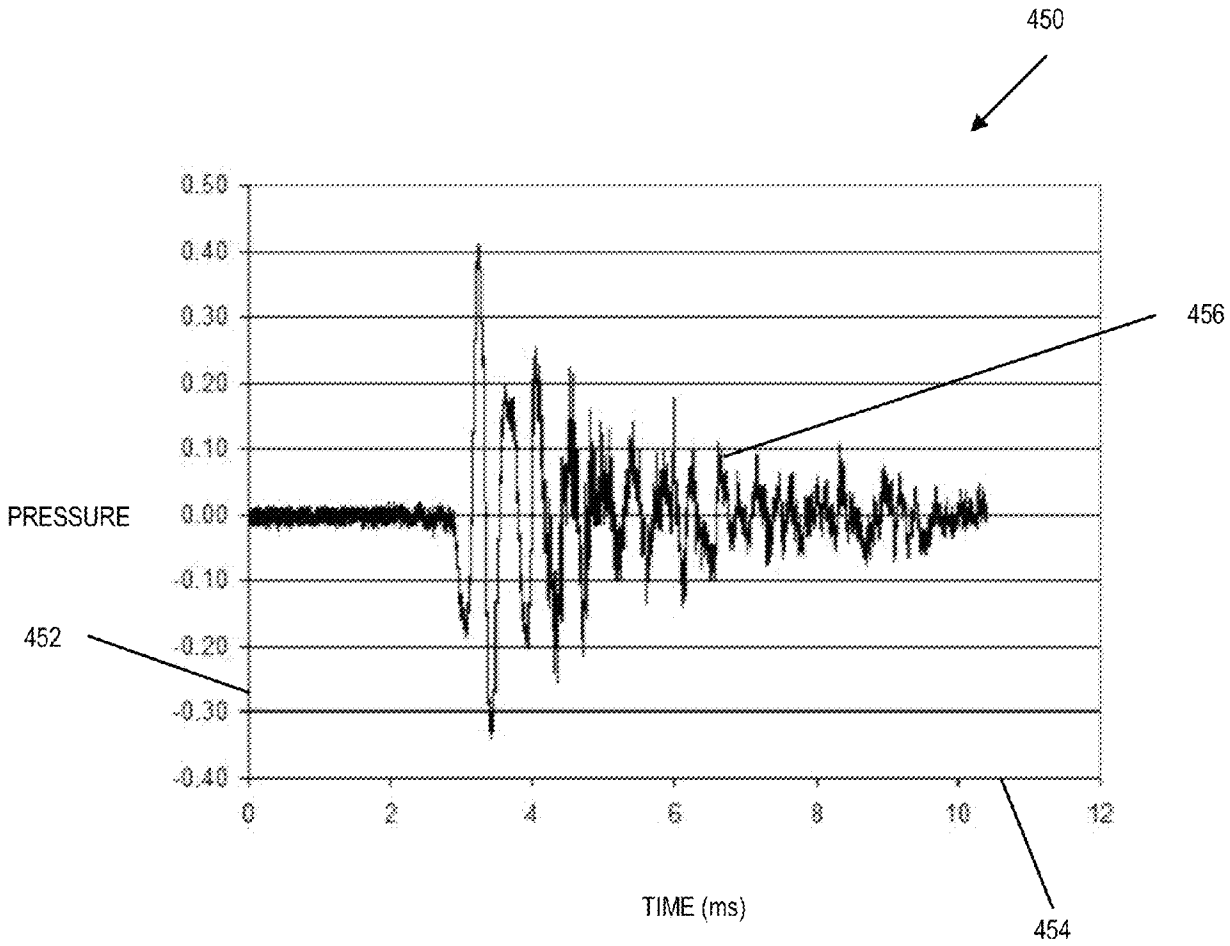
Figure 5A:
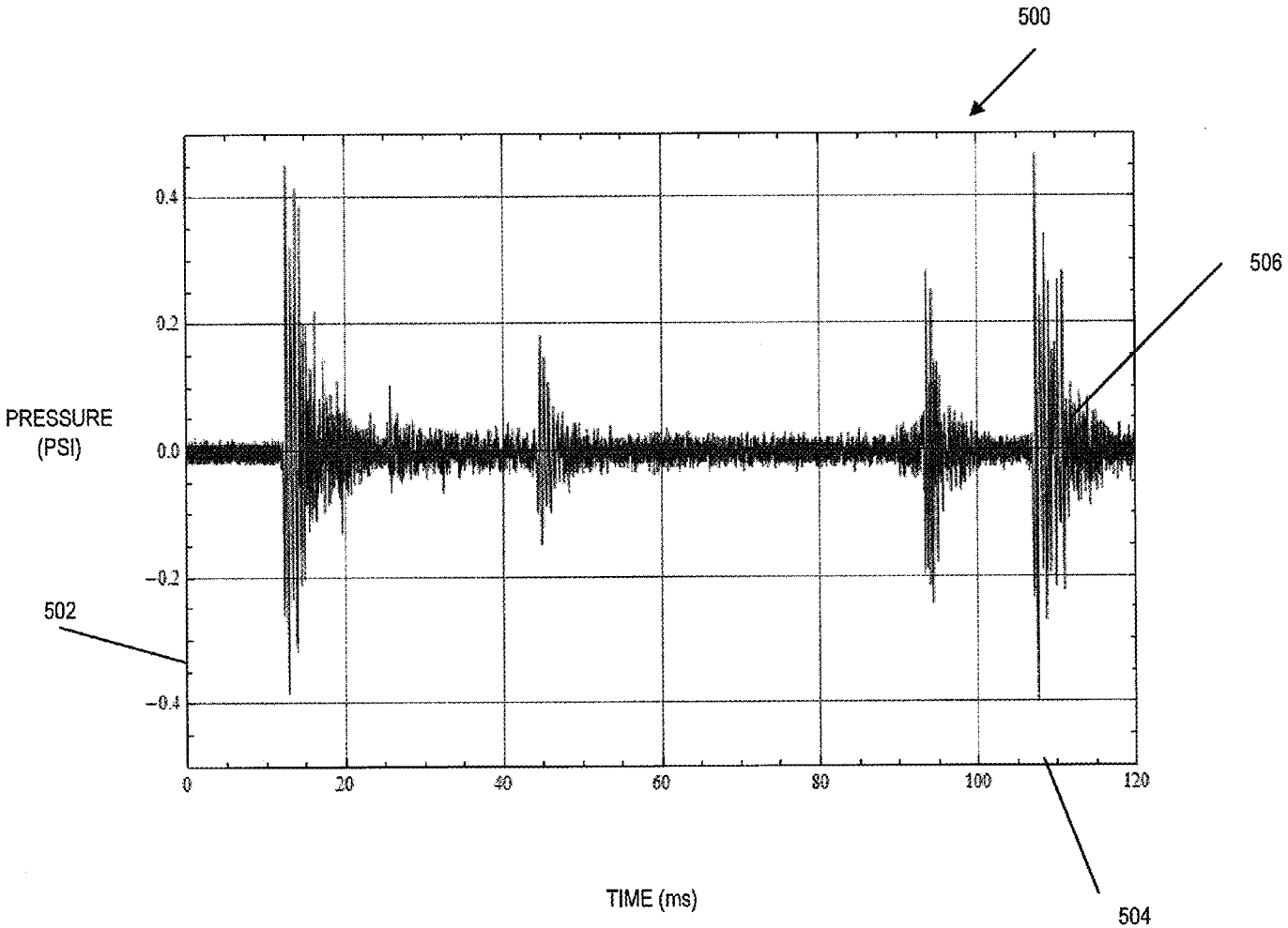
FIGS. 5A and 5B depict exemplary graphs for sensor output during a two round burst from an exemplary weapon firing of an exemplary weapon.
Figure 5B:
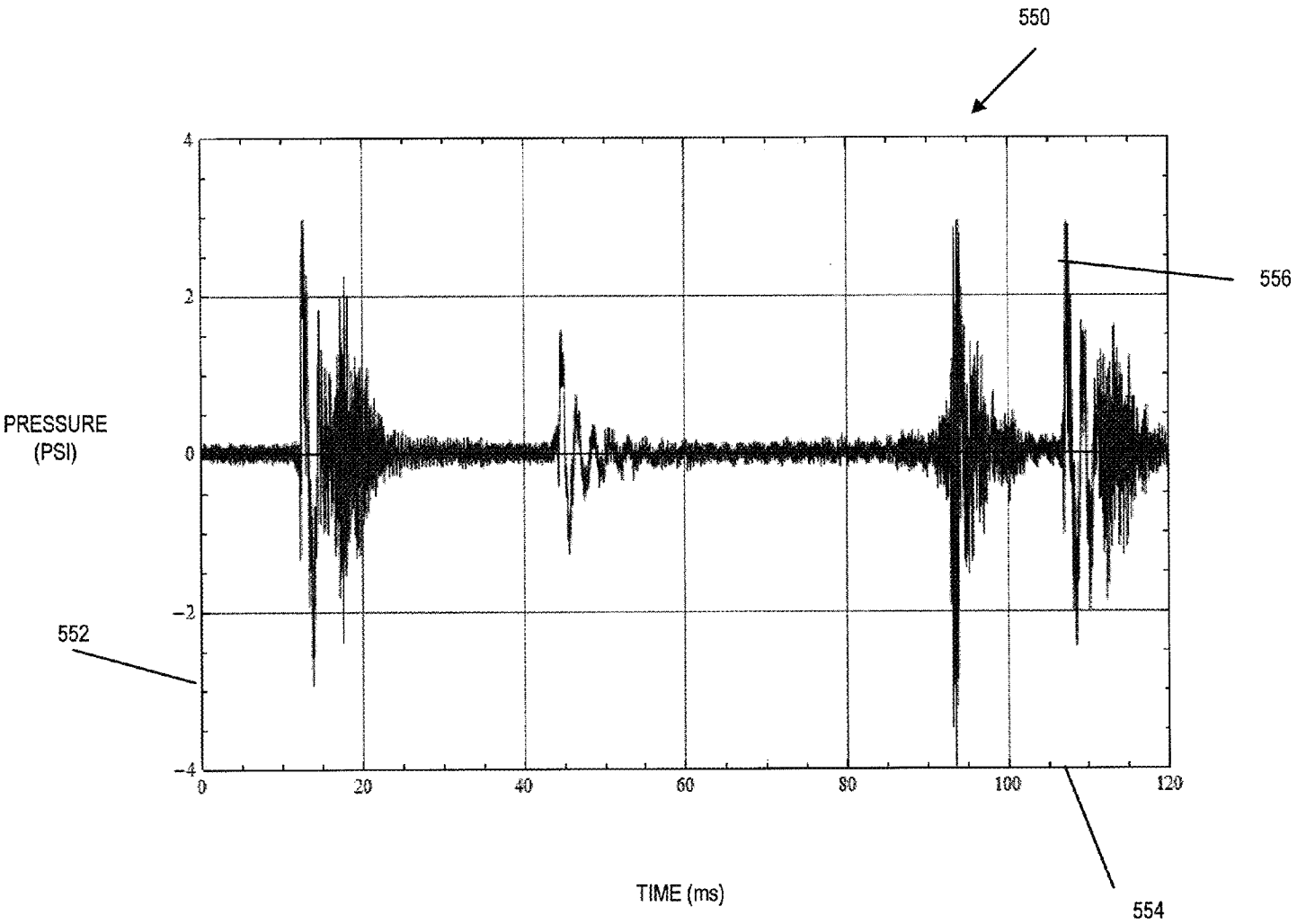

FIGS. 4A and 4B depict exemplary graphs 400, 450 for a pressure sensor 101 output and an accelerometer 102 output, respectively, during a single exemplary weapon firing of the exemplary weapon 302. FIGS. 5A and 5B depict exemplary graphs 500 and 550 for a pressure sensor 101 output and an accelerometer 102 output, respectively, during a two round burst from an exemplary weapon firing of the exemplary weapon 302. In an exemplary embodiment of the invention, the exemplary weapon 302 may generate generic waveforms and/or unique waveform when compared to a related weapon. A generic waveform may be identical or similar to waveforms generated by related weapons. A unique waveform may be a waveform that is specific to the exemplary weapon 302. In an exemplary embodiment, the exemplary weapon 302 may generate a waveform which is, in part, both generic and unique when compared to a related weapon.

In an exemplary embodiment, a related weapon may refer to a weapon of the same model type, a weapon of a related model type, and/or a weapon of a different model type which contains one or more components in common with the exemplary weapon 302, such as, but not limited to, components of the firing mechanism and/or the loading mechanism. Related weapons may generate generic and/or unique waveforms when compared to other related weapons depending on the behavior of the common components.

Returning to FIGS. 4A and 4B, FIG. 4A may represent exemplary pressure sensor 101 data resulting from a single shot fired from the exemplary weapon 302 with the apparatus 100 attached. In an exemplary embodiment, the exemplary weapon 302 may be a M16 rifle. The pressure sensor line 406 of graph 400 may plot the values sensed by pressure sensor 101, for example, in pounds per square inch, on the y-axis 402 versus the time on the x-axis 404, measured, for example, in milliseconds.

FIG. 4B may represent exemplary accelerometer 102 data resulting from a single shot fired from the exemplary weapon 302 with the apparatus 100 attached. In an exemplary embodiment, the exemplary weapon 302 may be a M16 rifle. The accelerometer line 456 of graph 450 plots the values sensed by the accelerometer 102, for example, in pounds per square inch, on the y-axis 452 versus the time on the x-axis 454, measured, for example, in milliseconds.

In FIGS. 4A and 4B, both sensors, as indicated by the pressure sensor line 406 and the accelerometer line 456, may be quiet from 0 ms until approximately 2.5 ms. During this time the exemplary weapon 302 may be aimed, held still, etc. At time period 2.75 ms however, both sensors may detect movement of the firing pin forward towards the primer and the firing pin's contact with the primer, which starts the pyrotechnic chain. At approximately 4 ms the exemplary weapon 302 may reach maximum rearward acceleration. At approximately 4 ms to 4.5 ms the rearward acceleration of the exemplary weapon 302 may stop and the sensors detect a maximum pressure as the bullet exits the muzzle. The time point, for example, but not limited to, at which the bullet exits the gun may be marked and the GPS location of the M16 rifle is stored in memory 106. Sensor readings recorded after the bullet exits the muzzle, i.e. at approximately 4.5 ms to 10 ms, may illustrate the decay of oscillations after a firing.

Returning to FIGS. 5A and 5B, FIG. 5A may depict exemplary pressure sensor 101 data resulting from a double round burst from an exemplary weapon firings of the exemplary weapon 302. In an exemplary embodiment, the exemplary weapon 302 may be a M16 rifle. The pressure sensor line 506 of graph 500 may plot the values sensed by pressure sensor 101, for example, in pounds per square inch, on the y-axis 502 versus the time on the x-axis 504, measured, for example, in milliseconds.

FIG. 5B may depict exemplary accelerometer 102 data resulting from a double round burst from an exemplary weapon firings of the exemplary weapon 302. In an exemplary embodiment, the exemplary weapon 302 may be a M16 rifle. The accelerometer line 556 of graph 550 may plot the values sensed by pressure sensor 101, for example, in pounds per square inch, on the y-axis 552 versus the time on the x-axis 554, measured, for example, in milliseconds.

In FIGS. 5A and 5B, both sensors may be quiet from 0 ms until approximately 11 ms, as indicated by pressure sensor line 506 and accelerometer line 556. During this time the exemplary weapon 302 may be aimed, held still, etc. At time period 11.25 ms however, both sensors may detect movement of the firing pin forward towards the primer and the firing pin's contact with the primer, which starts the pyrotechnic chain. At approximately 13 ms the exemplary weapon 302 may reach maximum rearward acceleration. At approximately 13.5 ms to 14 ms the rearward acceleration of the exemplary weapon 302 may stop and the sensors detect a maximum pressure as the bullet exits the muzzle. This time point is marked and the GPS location of the M16 rifle is stored in memory 106. Sensor readings recorded after the bullet exits the muzzle, i.e. at 14 ms to 25 ms, may illustrate the decay of oscillations after a firing.

Continuing with graphs 500 and 550 of FIGS. 5A and 5B, at approximately 45 ms the pressure sensor 101 and/or the accelerometer 102 may detect the bolt stopping abruptly in the buffer in its rearward travel. From approximately 90 ms to 100 ms, the pressure sensor 101 and/or the accelerometer 102 may detect the bolt picking up the next round from the clip, the bolts movement forward, and the bolt closing. At approximately 111 ms both sensors may detect movement of the firing pin forward towards the primer and the firing pin's contact with the primer, which starts the pyrotechnic chain. At approximately 111.75 ms the exemplary weapon 302 reaches maximum rearward acceleration. At approximately 112.5 ms to 113 ms the rearward acceleration of the exemplary weapon 302 stops and the sensors detect a maximum pressure as the bullet exits the muzzle. This time point is marked and the GPS location of the M16 rifle is stored in memory 106. Sensor readings recorded after the bullet exits the muzzle, i.e. at 113 ms to 120 ms, illustrate the decay of oscillations after a firing.

The data depicted in FIGS. 4A, 4B, 5A and 5B may be included in an exemplary firing signature for an exemplary M16 rifle, with the pressure sensor lines 406 and 506 representing a pressure sensor firing signature and accelerometer lines 456 and 556 representing an accelerometer firing signature. Different weapons may have a different firing signature, and a single weapon may have multiple firing signatures depending on the modes that weapon may be fired in. For example, FIGS. 4A and 4B may be a firing signature for a single shot from an M16 rifle, and the microcontroller 104 may determine if a weapon has been fired by comparing data from the pressure sensor 101 and the accelerometer 102 of the weapon to the known firing signature. FIGS. 4A and 4B may be a firing signature for a first shot and a consecutive shot from exemplary weapon 302. As will be described in further detail below, the microcontroller 104 may determine if a weapon has been fired by comparing data from the pressure sensor 101 and the accelerometer 102 to the known firing signature for the exemplary weapon. In an exemplary embodiment, the data from the pressure sensor 101 and the accelerometer 102 may be output to another computer where the data may be compared to the firing signature for the weapon in order to determine if the weapon was fired.

Figure 6:
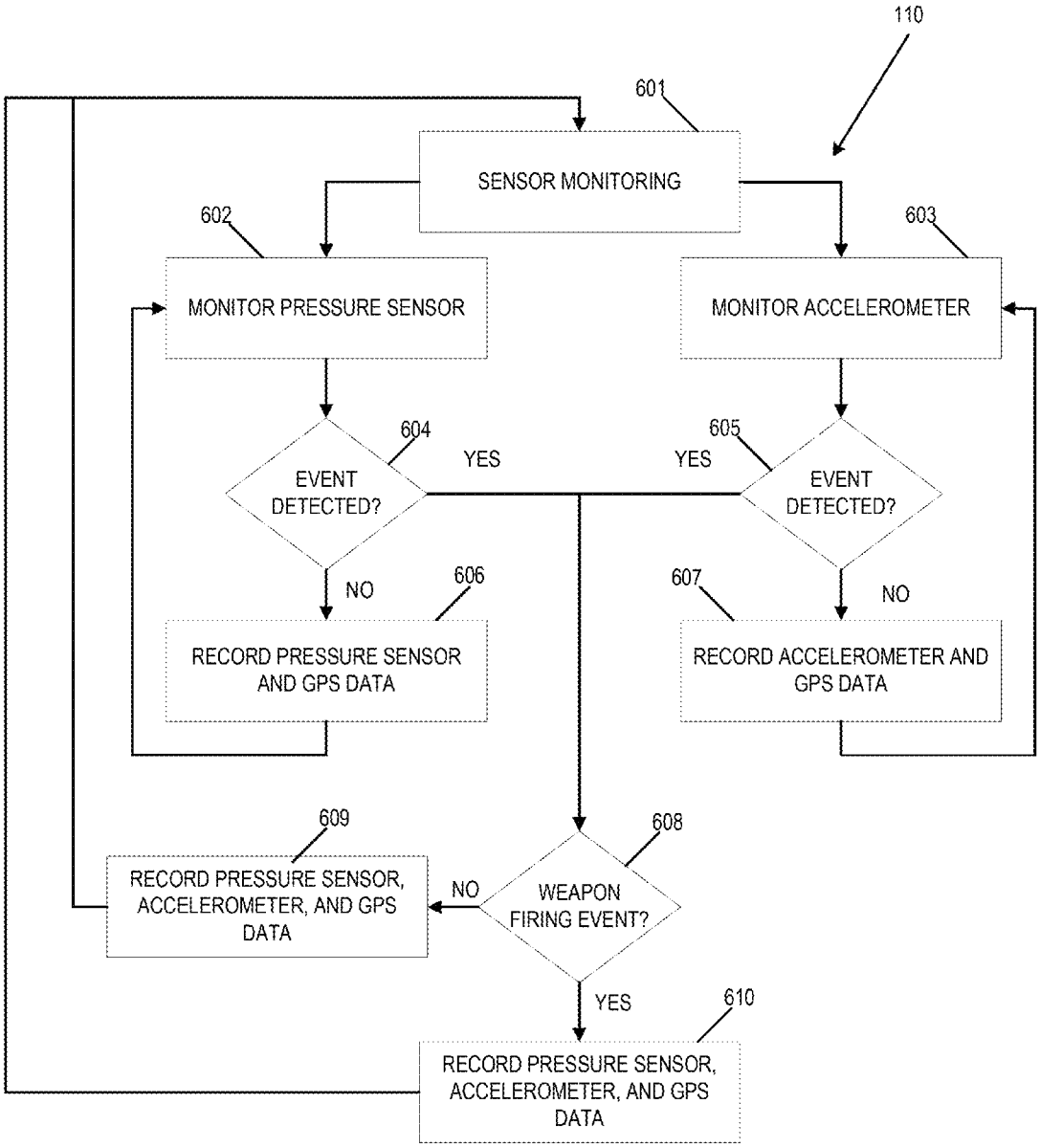
FIG. 6 depicts an exemplary flowchart for the operation of an apparatus for registering the time and location of weapon firings.

FIG. 6 depicts an exemplary flowchart 600 for the operation of an exemplary apparatus for registering the time and location of weapon firings, and will be described with respect to FIGS. 1, 3, 4A, and 4B. Flowchart 600 may, for example, but not limited to, take place in real-time or on a time delay.

In block 601, after the apparatus 100 has been attached to the exemplary weapon 302, for example, via the rail mounts 202, the apparatus 100 may be turned on, or remain on, and the microcontroller 104 may being monitoring data received from the pressure sensor 101 and the accelerometer 102. From 601, 600 may continue with both 602 and 603 in parallel, in an exemplary embodiment.

In block 602, the microcontroller 104 may monitor data received from the pressure sensor 101. Data from the pressure sensor 101 may be sent continuously to the microcontroller 104, or the microcontroller 104 may poll the pressure sensor 101 for data. The data received may be stored in memory 106. From 602, 600 may continue with 604.

In block 603, the microcontroller 104 may monitor data received from the accelerometer 102. Data from the accelerometer 102 may be sent continuously to the microcontroller 104, or the microcontroller 104 may poll the accelerometer 102 for data. Block 602 and block 603 may be performed simultaneously if the microcontroller 104 is capable of parallel receipt and processing of data, or in a sequential, alternating cycle. Data may be stored in memory 106. From 603, 600 may continue with 605.

In block 604, the microcontroller 104 may check the data received from the pressure sensor 101 to determine if a potential weapon firing event has occurred. A potential weapon firing event may result from a weapon firing event or a non-weapon firing event. A non-weapon firing event may be any event, other than a weapon firing event, which appears to be similar to a weapon firing event based on the data from the pressure sensor 101. For example, the firing of a different weapon in close proximity to the pressure sensor 101 may result in data from the pressure sensor 101 that would appear to the microcontroller 104 to be similar to an actual firing of the weapon.

The microcontroller 104 may determine if a potential weapon firing event has occurred by comparing data received from the pressure sensor 101 with previously stored/known data and/or parameters, for example, data gathered during testing of the weapon and the pressure sensor 101 (such as, e.g., but not limited to, data gathered in FIGS. 4A, 4B, 5A, and 5B). The stored data and/or parameters may be in the form of a firing signature. If no potential firing event has occurred, flow may proceed to block 606 of flow diagram 600. Otherwise, if a potential firing event has occurred, flow may proceed to block 608 of flow diagram 600.

In block 605, the microcontroller 104 may check the data received from the accelerometer 102 to determine if a potential weapon firing event has occurred. A potential firing event may result from a weapon firing event or a non-weapon firing event. A non-weapon firing event may be any event, other than a weapon firing event, which appears to be similar to a weapon firing event based on the data from the accelerometer 102. For example, the weapon being dropped or jarred may result in data from the accelerometer 102 that would appear to the microcontroller 104 to be similar to an actual firing of the weapon.

The microcontroller 104 determine if a potential weapon firing event has occurred by comparing data received from the accelerometer 102 with previously stored data and/or parameters, for example, data gathered during testing of the weapon and the accelerometer 102 (such as, e.g., but not limited to, data gathered in FIGS. 4A, 4B, 5A, and 5B). The stored data and/or parameters may be in the form of a firing signature. If no potential firing event has occurred, flow may proceed back to block 607 of flow diagram 600. If a potential firing event has occurred, flow may proceed to block 608 of flow diagram 600.

For example, as with the data from pressure sensor 101, the data from the accelerometer 102 may be compared with accelerometer line 456 and/or accelerometer line 556 from FIGS. 4B and 5B. The accelerometer lines 456 and 556 may represent the accelerometer 102 firing signature for a single shot and burst shot, respectively, of an exemplary weapon. Combining the accelerometer 102 firing signatures with the respective pressure sensor 101 firing signatures may result in a single shot firing signature and burst shot firing signature for an exemplary weapon. Block 604 and block 605 may be performed simultaneously if the microcontroller 104 is capable of parallel receipt and processing of data, or in a sequential, alternating cycle.

In block 606, the microcontroller 104 may write data from the non-potential weapon firing event to the memory 106 and/or transmit the data in real-time via input/output data port 109. The data may include data from the pressure sensor 101, the time at which the non-potential weapon firing event took place, and the location of the weapon when the non-potential weapon firing event took place. The microcontroller 104 may receive data on the time and the location of the exemplary weapon 302 from the GPS receiver 105.

In an exemplary embodiment, a non-weapon firing event may include, e.g., but is not limited to, the dropping of the weapon, a weapon malfunction (such as, but not limited to, a jam), reloading the weapon, and/or the firing of another weapon in proximity to the exemplary weapon, etc. From 606, flow 600 may continue to 602.

In block 607, the microcontroller 104 may write data from the non-potential weapon firing event to the memory 106 and/or transmit the data in real-time via input/output data port 109. The data may include data from the accelerometer 102, the time at which the non-potential weapon firing event took place, and the location of the weapon when the non-potential weapon firing event took place. The microcontroller 104 may receive data on the time and the location of the exemplary weapon 302 from the GPS receiver 105.

In an exemplary embodiment, a non-weapon firing event may include, e.g., but is not limited to, the dropping of the weapon, a weapon malfunction (such as, but not limited to, a jam), reloading the weapon, and/or the firing of another weapon in proximity to the exemplary weapon, etc. From 607, flow 600 may continue with 603.

In block 608, the microcontroller 104 may check the data from the pressure sensor 101 and/or the accelerometer 102 to determine if a weapon firing event occurred (i.e. determine whether the potential weapon firing events detected in block 604 and/or 605 are weapon firing events). The microcontroller 104 may determine that a weapon firing event occurred when a potential weapon firing event was detected in both block 604 and block 605. The microcontroller 104 may also compare the data from both the pressure sensor 101 and the accelerometer 102 to previously stored data and/or parameters, as in blocks 604 and 605, to confirm that a weapon firing event has occurred. If a non-weapon firing event has occurred (i.e. a potential firing event was not detected in both block 604 and 605), flow 600 may proceed to block 609. If it is determined in 608 that a weapon firing event has occurred, flow 600 may proceed to block 610. In another exemplary embodiment, in the event of a non-weapon firing event, flow 600 may continue to 601.

In block 609, the microcontroller 104 may write data from the non-weapon firing event to the memory 106 and/or transmit the data in real-time via input/output data port 109. The data may include data from the pressure sensor 101 and the accelerometer 102, the time at which the non-weapon firing event took place, and the location of the weapon when the weapon firing event took place. The microcontroller 104 may receive data on the time and the location of the exemplary weapon 302 from the GPS receiver 105.

In an exemplary embodiment, a non-weapon firing event may include, e.g., but is not limited to, the dropping of the weapon, a weapon malfunction (such as, but not limited to, a jam), reloading the weapon, and/or the firing of another weapon in proximity to the exemplary weapon, etc. From 609, flow 600 may continue with 601.

For example, if a different weapon was fired in proximity to the pressure sensor 101, the data from the pressure sensor 101 may appear to indicate that the exemplary weapon 302 has been fired, matching, for example, the weapon's pressure sensor 101 firing signature. However, since the exemplary weapon 302 was not fired, the data from the accelerometer 102 would not corroborate the data from the pressure sensor 101, as the data would not, for example, match the weapon's accelerometer 102 firing signature. The firing of a different weapon in proximity to the accelerometer 102 may not result in the exemplary weapon 302 the accelerometer 102 is attached to moving, so data from the accelerometer 102 would not match the stored data and/or parameters, i.e., the weapon firing signature, for an actual weapon firing.

As another example, if the weapon is dropped, the data from accelerometer 102 may appear to indicate that the weapon has been fired, for example, matching the weapon's accelerometer 102 firing signature. However, since the weapon was not fired, data from the pressure sensor 101 may not corroborate the data from the accelerometer 102, for example, not matching the weapon's pressure sensor 101 firing signature, as dropping a weapon may not result in the pressure sensor 102 registering changes in pressure that are consistent with a weapon firing.

In block 610, the microcontroller 104 may write data from the weapon firing event to the memory 106 and/or transmit the data in real-time via input/output data port 109. The data may include data from the pressure sensor 101 and the accelerometer 102, the time at which the weapon firing event took place, and the location of the weapon, when the weapon firing event took place, etc. The microcontroller 104 may receive data on the time and the location of the weapon from the GPS receiver 105.

When the memory 106 of the apparatus is accessed later, the memory 106 may include a record of every firing or non-weapon firing event of the exemplary weapon 302 to which the apparatus has been attached, including the time of the firing, the location of the weapon during each weapon firing event, the data from the pressure sensor 101, and the accelerometer 102 that caused the microcontroller 104 to determine that a firing took place. The memory 106 may also include data from the momentary switch 110, indicating, for example, the time of a weapon jam, and the time the jam was cleared. The data may also be transmitted in real-time via input/output data port 109 to an external computing device, for example.

In an exemplary embodiment, the record of the weapon firing may be used for a variety of purposes, including, for example, testing the efficacy of the weapon in a live fire situation, manufacturing additional apparatuses for registering the time and location of weapon firings, testing the ability of the user of the weapon, and/or tracking weapon usage for maintenance purposes. When used to manufacture additional apparatuses for registering the time and location of weapon firings, the record of weapon firing may be used to load generic waveforms into the additional apparatuses. When used for maintenance purposes, the record of exemplary weapon firings over a period of time may be compared to determine if the weapon is in need of repair or maintenance, such as, but not limited to, when the data from the accelerometer 102 or pressure sensor 101 changes significantly over time.

In controlled live fire testing, targets may be set up with equipment capable of recording data of projectiles fired at the targets or in proximity to the targets. Such data may be correlated, by various means, with the data from the memory 106 of one or more of the apparatus 100 attached to one or more weapons, allowing for most, if not all, of the shots fired in the testing to be tracked from the firing of the weapon to the projectile passing on or near a target, or completely missing the target. Methods and systems for such tracking are discussed in the applications cross referenced above.

Figure 7:
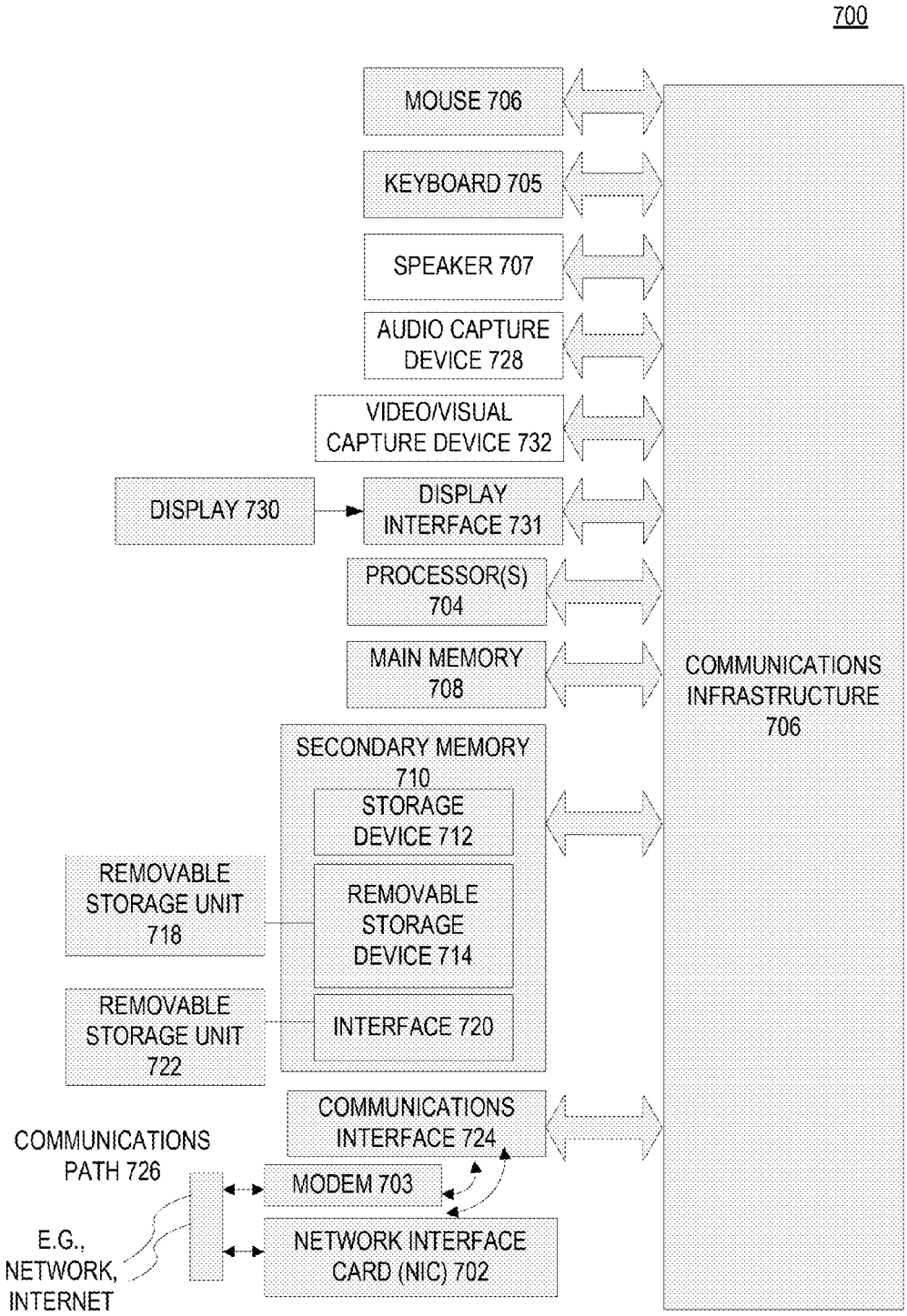
FIG. 7 depicts diagram 700 illustrating an exemplary computer system.

FIG. 7 depicts diagram illustrating an exemplary computer system 700 such as may be used in, or in combination with devices 101-112, etc. and that may be used in implementing an exemplary embodiment of the present invention. Specifically, FIG. 7 depicts an exemplary embodiment of a computer system 700 that may be used in computing devices such as, e.g., but not limited to, a client and/or a server, etc., according to an exemplary embodiment of the present invention. The present invention (or any part(s) or function(s) thereof) may be implemented using hardware, software, firmware, and/or a combination thereof and may be implemented in one or more computer systems 700 or other processing systems. In fact, in one exemplary embodiment, the invention may be directed toward one or more computer systems capable of carrying out the functionality described herein. An example of a computer system 700 is shown in FIG. 7, depicting an exemplary embodiment of a block diagram of an exemplary computer system 700 useful for implementing the present invention. Specifically, FIG. 7 illustrates an example computer 700, which in an exemplary embodiment may be, e.g., but not limited to, a personal computer (PC) system running an operating system such as, e.g., (but not limited to) MICROSOFT® WINDOWS® NT/98/2000/XP/CE/ME/VISTA/etc. available from MICROSOFT® Corporation of Redmond, Wash., U.S.A. However, the invention may not be limited to these platforms. Instead, the invention may be implemented on any appropriate computer system running any appropriate operating system such as, e.g., but not limited to, an Apple computer executing MAC OS. In one exemplary embodiment, the present invention may be implemented on a computer system operating as discussed herein. An exemplary computer system, computer 700 is shown in FIG. 7. Other exemplary computer systems may include additional components, such as, e.g., but not limited to, a computing device, a communications device, mobile phone, a telephony device, an iPhone (available from Apple of Cupertine, Calif. USA), a 3G wireless device, a wireless device, a telephone, a personal digital assistant (PDA), a personal computer (PC), a handheld device, a portable device, an interactive television device (iTV), a digital video recorder (DVD), client workstations, thin clients, thick clients, fat clients, proxy servers, network communication servers, remote access devices, client computers, server computers, peer-to-peer devices, routers, gateways, web servers, data, media, audio, video, telephony or streaming technology servers, game consoles, content delivery systems, etc., may also be implemented using a computer such as that shown in FIG. 7. In an exemplary embodiment, services may be provided on demand using, e.g., but not limited to, an interactive television device (iTV), a video on demand system (VOD), via a digital video recorder (DVR), and/or other on demand viewing system.

The computer system 700 may include one or more processors, such as, e.g., but not limited to, processor(s) 704. The processor(s) 704 may be coupled to and/or connected to a communication infrastructure 706 (e.g., but not limited to, a communications bus, cross-over bar, or network, etc.). Various exemplary embodiments may be described in terms of this exemplary computer system 700. After reading this description, it may become apparent to a person skilled in the relevant art(s) how to implement the invention using other computer systems and/or architectures.

Computer system 700 may include a display interface 731 that may forward, e.g., but not limited to, graphics, text, and other data, etc., from the communication infrastructure 706 (or from a frame buffer, etc., not shown) for display on the display unit 730.

The computer system 700 may also include, e.g., but may not be limited to, a main memory 708, random access memory (RAM), and a secondary memory 710, etc. The secondary memory 710 may include a computer readable medium such as, for example, (but not limited to) a hard disk drive 712 and/or a removable storage drive 714, representing a floppy diskette drive, a magnetic tape drive, an optical disk drive, magneto-optical, a compact disk drive CD-ROM, etc. The removable storage drive 714 may, e.g., but not limited to, read from and/or write to a removable storage unit 718 in a well known manner. Removable storage unit 718, also called a program storage device or a computer program product, may represent, e.g., but not limited to, a floppy disk, magnetic tape, optical disk, compact disk, etc. which may be read from and written to by removable storage drive 714. As may be appreciated, the removable storage unit 718 may include a computer usable storage medium having stored therein computer software and/or data. In some embodiments, a "machine-accessible medium" may refer to any storage device used for storing data accessible by a computer. Examples of a machine-accessible medium may include, e.g., but not limited to: a magnetic hard disk; a floppy disk; an optical disk, like a compact disk read-only memory (CD-ROM), flash memory, non-volatile memory, or a digital versatile disk (DVD); digital video recorder disk (DVR); a magnetic tape; and a memory chip, etc.

In alternative exemplary embodiments, secondary memory 710 may include other similar devices for allowing computer programs or other instructions to be loaded into computer system 700. Such devices may include, for example, a removable storage unit 722 and an interface 720. Examples of such may include a program cartridge and cartridge interface (such as, e.g., but not limited to, those found in video game devices), a removable memory chip (such as, e.g., but not limited to, an erasable programmable read only memory (EPROM), or programmable read only memory (PROM) and associated socket, and other removable storage units 722 and interfaces 720, which may allow software and data to be transferred from the removable storage unit 722 to computer system 700.

Computer 700 may also include an input device such as, e.g., (but not limited to) a mouse 706 or other pointing device such as a digitizer, an audio capture device 728 (such as, e.g., but not limited to, a microphone), an image video/visual capture device 732 (such as, e.g., but not limited to, a camera), and a keyboard 705 and/or other data entry device (not shown), etc.

Computer 700 may also include output devices, such as, e.g., (but not limited to) display 730, display interface 731, and/or a speaker 707, etc. Other output devices may also be used, including, e.g., but not limited to, a printer, etc. Computer 700 may include input/output (I/O) devices such as, e.g., (but not limited to) communications interface 724 and communications path 726, etc. These devices may include, e.g., but not limited to, a network interface card 702, and modem(s) 703. Communications interface 724 may allow software and data to be transferred between computer system 700 and external devices.

In this document, the terms "computer program medium" and "computer readable medium" may be used to generally refer to media such as, e.g., but not limited to removable storage drive 714, a hard disk installed in hard disk drive 712, a storage area network (SAN), database, etc. These computer program products may provide software to computer system 700. The invention may be directed to such computer program products. In some cases, a computer program product may include software which may be distributed via a communication system and then may be stored on a storage device.

While various exemplary embodiments have been described above, it should be understood that they have been presented by way of example only, and not limitation. Thus, the breadth and scope of the present invention should not be limited by any of the above-described exemplary embodiments, but should instead be defined only in accordance with the following claims and their equivalents.

What is claimed is:

1. An apparatus for registering time and location of a weapon firing event of a weapon comprising:

a portable housing adapted to be removably mounted directly on the weapon;

a microcontroller disposed in the housing;

a pressure sensor disposed at the housing and adapted to determine pressure data based on air pressure in proximity to the weapon and provide said pressure data to said microcontroller;

an accelerometer located at the housing and adapted to determine acceleration data of the weapon based on movement of the weapon and provide said acceleration data to said microcontroller;

a location sensor located at the housing and adapted to determine a time and a location of the weapon and provide said time and said location of the weapon to said microcontroller; and a memory disposed in the housing and coupled to said microcontroller, wherein said microcontroller is adapted to;

determine if a potential weapon firing event occurred based on the acceleration data;

determine if the potential weapon firing event occurred based on the pressure data; and determine the weapon firing occurred only when both of the acceleration data and the pressure data independently and concurrently indicate that the potential weapon firing event occurred; and wherein said microcontroller is adapted to retrieve and then transmit said acceleration data, said pressure data, said time, and said location of the weapon when the weapon firing occurred for storage in said memory.

2. The apparatus of claim 1, further comprising:

a momentary switch coupled to said microcontroller and adapted allow a user to communicate at least one of said pressure sensor, said accelerometer, said time device, said location device, and said microcontroller.

3. The apparatus of claim 1, further comprising:

a momentary switch coupled to at least one of said pressure sensor, said accelerometer, said time device, and said location device and adapted to turn at least one of said pressure sensor, said accelerometer, said time device, said location device, and said microcontroller on and off.

4. The apparatus of claim 1, further comprising:

an input/output (I/O) data port, wherein said data port is coupled to said microcontroller.

5. The apparatus of claim 4, wherein said I/O data port comprises at least one of a wireless interface or a wired interface.

6. The apparatus of claim 1, wherein said microcontroller comprises digital signal processing (DSP) capabilities.

7. The apparatus of claim 6, further comprising:

a signal conditioning unit coupled to at least one of said pressure sensor or said accelerometer and adapted to condition said pressure data and said acceleration data before said pressure data and said acceleration data is provided to said microcontroller.

8. The apparatus of claim 1, further comprising:

a power supply.

9. The apparatus of claim 8, wherein said power supply comprises at least of:

a battery;

a rechargeable battery;

a nonrechargeable battery;

a fuel cell; or a hydrogen fuel cell.

10. The apparatus of claim 1, wherein said memory is further adapted to store a weapon firing signature including stored pressure and acceleration data for said weapon, and wherein said microcontroller is adapted to determine if the weapon firing has occurred by comparing said acceleration data and said pressure data to said weapon firing signature.

11. The apparatus of claim 1 further comprising:

a transceiver for transmitting said acceleration data, said pressure data, said time, and said location of the weapon when the weapon firing occurred for storage in said memory.

12. The apparatus of claim 11, wherein said transceiver comprises at least one of a wired interface, a wireless interface, RS-232 interface, a wired USB port, a firewire port, an eSATA port, and/or a proprietary port, or a wireless USB device, Bluetooth device, or IEEE 802.11x standard wi-fi connection, and IEEE 802.16x wimax connection.

13. A method for registering time and location of a weapon firing of a weapon comprising:

determining pressure data with a pressure sensor based on air pressure in proximity to the weapon;

determining acceleration data with an accelerometer based on movement of the weapon;

analyzing said pressure data with a computer to determine if the weapon firing has occurred;

analyzing said acceleration data with the computer to determine if the weapon firing has occurred;

determining a weapon firing event occurred only when both of the acceleration data and the pressure data independently and concurrently indicate that the weapon firing occurred; and if the weapon firing event has occurred:

determining a time of the weapon firing;

determining a location of the weapon firing; and storing said pressure data, said acceleration data, said time, and said location in a memory.

14. The method of claim 13, further comprising:

transmitting said pressure data, said acceleration data, said time, and said location to a device for storage.

15. The method of claim 13, wherein said analyzing step further comprises comparing said acceleration data and said pressure data to a weapon firing signature to determine if the weapon firing has occurred.

16. A method for registering time and location of a weapon firing comprising:

receiving pressure data from a pressure sensor based on air pressure in proximity to the weapon;

receiving acceleration data from an accelerometer based on movement of the weapon;

receiving a current time;

receiving a current location of the weapon;

analyzing with a computer said pressure data to determine if the weapon firing has occurred;

analyzing said acceleration data with the computer to determine if the weapon firing has occurred;

determining a weapon firing event occurred only when both of the acceleration data and the pressure data concurrently and independently indicate that the weapon firing occurred; and if the weapon firing event has occurred, storing said pressure data, said acceleration data, said time, and said location in a memory.

17. The method of claim 16, further comprising:

transmitting said pressure data, said acceleration data, said time, and said location to a device for storage.

18. The method of claim 16, wherein said analyzing step further comprises comparing said acceleration data and said pressure data to a weapon firing signature to determine if the weapon firing has occurred.

* * * * *